United States Patent [19]

Holz et al.

[11] 4,329,616

[45] May 11, 1982

[54] KEEP-ALIVE ELECTRODE ARRANGEMENT FOR DISPLAY PANEL HAVING MEMORY

[75] Inventors: George E. Holz, North Plainfield; James A. Ogle, Neshanic Station, both of N.J.

[73] Assignee: Burroughs Corporation, Detroit, Mich.

[21] Appl. No.: 108,805

[22] Filed: Dec. 31, 1979

[51] Int. Cl.[3] ..... H01J 17/00; H01J 61/00

[52] U.S. Cl. ..... 313/198; 313/217; 340/714; 340/769; 340/771

[58] Field of Search ..... 313/188, 217, 220, 198; 340/714, 769, 771

[56] References Cited

U.S. PATENT DOCUMENTS

| | | | |
|---|---|---|---|
| 2,925,530 | 2/1960 | Engelbart | 313/485 |
| 3,654,508 | 4/1972 | Caras | 313/198 |
| 3,693,046 | 9/1972 | Glaser | 340/769 |
| 4,105,930 | 8/1978 | Coleman | 340/714 |

*Primary Examiner*—Bruce C. Anderson

*Attorney, Agent, or Firm*—Kevin R. Peterson; Robert A. Green; David G. Rasmussen

[57] ABSTRACT

The disclosure is of a display panel comprising a gas-filled envelope made up of a base plate and face plate and having anode and cathode electrodes supported on the base plate and forming an array of D. C. gas discharge cells. An apertured electrode arrangement is mounted between the base plate and face plate and defines, with an A. C. electrode on the face plate, an array of quasi A. C. gas discharge display cells, there being one A. C. cell for each D. C. cell. The A. C. electrode is a transparent conductive film which is coated with insulating material.

The D. C. gas discharge cells are arrayed as a plurality of columns of scanning cells and, adjacent to the first column of these scanning cells, in a column of reset cells which are turned on before the first column of scanning cells are turned on in a scanning cycle.

The panel also includes a keep-alive arrangement which comprises an electrode on the face plate of the envelope, the electrode being coated with a layer of insulating material, to form an A. C. electrode, and this A. C. electrode is positioned in alignment with apertures in the apertured electrode arrangement, in which it generates excited particles for the reset cells. These excited particles assist the firing of the reset cells.

13 Claims, 5 Drawing Figures

KEEP-ALIVE ELECTRODE ARRANGEMENT FOR DISPLAY PANEL HAVING MEMORY

BACKGROUND OF THE INVENTION

Keep-alive electrodes or keep-alive cells have been used with most types of gas-filled cold cathode display devices to assist in initiating operation of these devices. In a typical D.C. gas-filled display device, in which the electrodes are in contact with the gas, the keep-alive cells are typically separate anode and cathode electrodes, also disposed in the gas. A new gas-filled display device which is described and claimed in copending application Ser. No. 51,313, filed June 22, 1979, includes the D.C. scanning cells and A.C. memory cells. This device is a memory panel, and it presents special keep-alive problems which are solved by a keep-alive arrangement comprising a novel combination of A.C. and D.C. electrodes.

DESCRIPTION OF THE PREFERRED EMBODIMENTS

Figure 1:
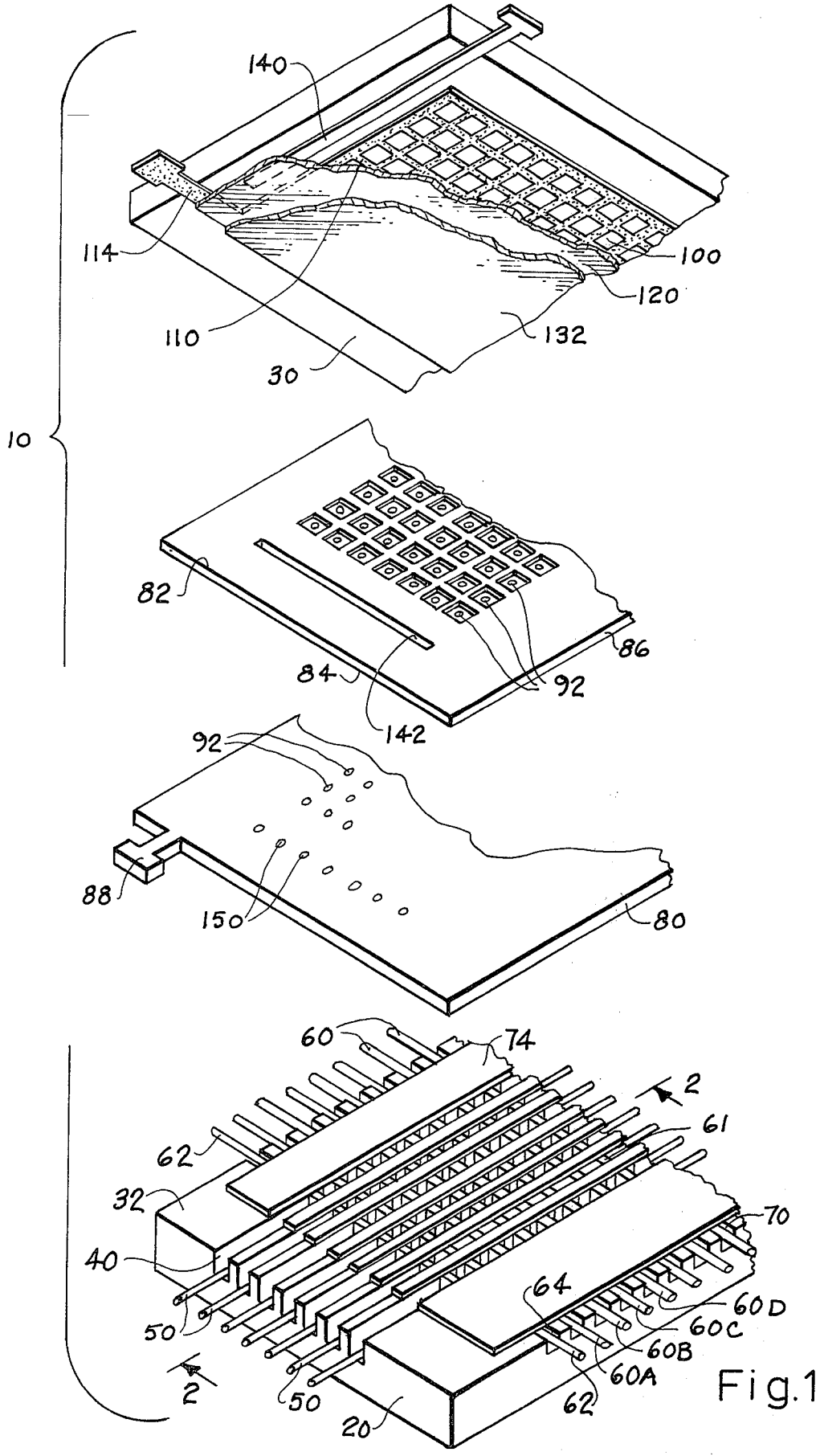
FIG. 1 is a perspective exploded view of a display panel embodying the invention.
Figure 2:
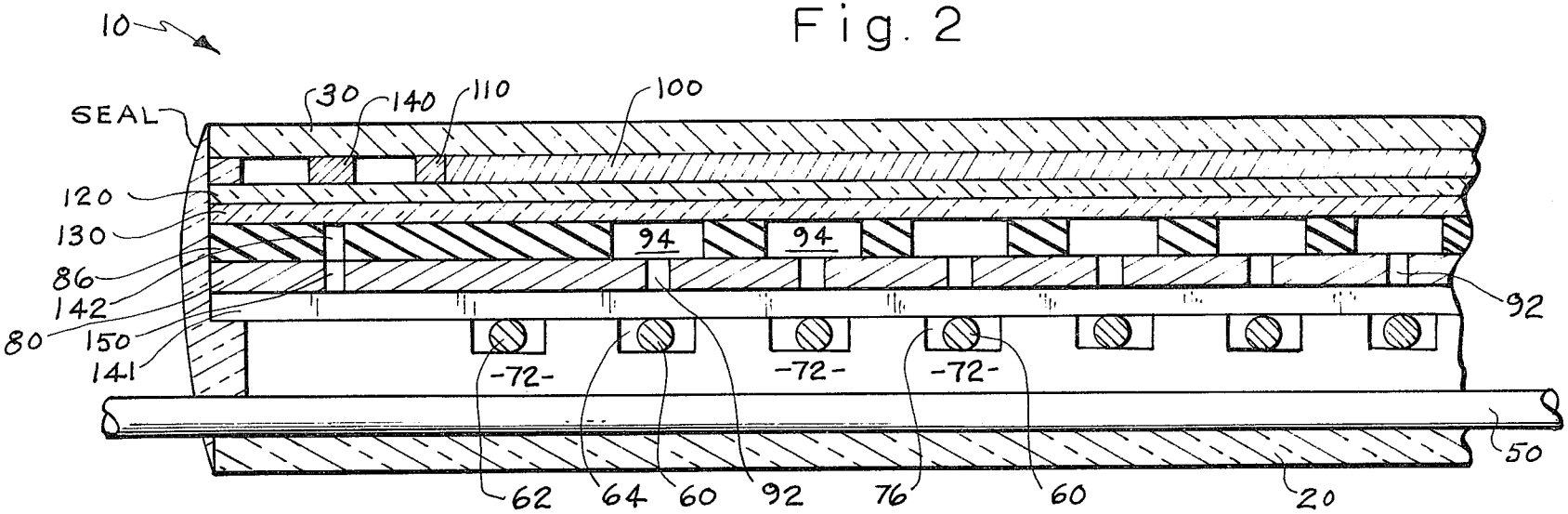
FIG. 2 is a sectional view through the panel of FIG. 1 along lines 2—2, with the panel shown assembled.

The present invention is embodied in a display panel 10 of the type described and claimed in copending application Ser. No. 51,313, filed June 22, 1979, and incorporated herein by reference, along with the publications cited herein. The display panel 10 includes a gas-filled envelope made up of an insulating base plate or substrate 20 and a glass face plate 30, which is shown tilted up and rotated to the left in FIG. 1 to present a view of its interior surface. These plates are hermetically sealed together, as illustrated in FIG. 2, along a closed periphery which surrounds the display cells 94 and the reset and keep-alive cells, leaving a gas-filled space and various electrodes between the plates. The base plate has a top surface 32, in which a plurality of relatively deep parallel slots 40 are formed and in each of which a scan/address anode electrode, for example a wire 50, is seated and secured.

A plurality of scan cathode electrodes in the form of wires 60 are seated in relatively shallow slots 70 in the top surface of the base plate. The slots 70 and scan cathodes 60 are disposed transverse to the slots 40 and scan anodes 50, and each crossing of a scan cathode 60 and a scan anode 40 defines a scanning cell 72. It can be seen that the scanning cells are arrayed in rows and columns. More specifically, the cathode portions 61, the underlying portions of anodes 50, and the intermediate gaseous regions define the scanning cells.

The scan cathodes 60A, B, C, etc., form a series of cathodes which can be energized serially in a scanning cycle, with cathode 60A being the first cathode energized in the scanning cycle.

A reset cathode strip or wire 62 is disposed in a slot 64 in the top surface of the base plate adjacent to the first scan cathode 60A, so that, when it is energized, it provides excited particles for cathode 60A at the beginning of a scanning cycle to be described. Where the reset cathode crosses each scan anode, a reset cell is formed, and the crossing of all of the scan anodes by the reset cathode provides a column of reset cells. These reset cells are turned on or energized at the beginning of each scanning cycle, and they expedite the turn-on of the first column of scanning cells associated with cathode 60A.

The panel 10 includes a keep-alive arrangement which is described in detail below.

In the panel 10, it is desirable that the cathodes 60, or at least the portions 61 thereof which are disposed in the scanning cells, be spaced uniformly from an electrode 80 disposed above the cathodes and described below. It is also desirable to provide means for preventing the spread of cathode glow from the operating portions 61 of the cathodes to the intermediate portions. These conditions may be satisfied by providing a thin slotted insulating sheet 74 on the top surface of the base plate 20. The slots 76 in the sheet 74 overlie the portions 61 of the cathodes, and the lower surface of the sheet either touches the intermediate portions of the cathodes or is so close to these portions that cathode glow does not spread along the cathodes from one operating portion 61 to the next. Alternatively, sheet 74 can have a separate aperture for each cathode portion 61, rather than slots, and it can advantageously be formed as a screen printed layer, rather than a sheet.

The portions of the panel described up to this point comprise the base plate assembly. This is the D.C. portion and the scanning and addressing portion of the panel.

Adjacent to the base plate assembly is the second portion of the panel which is a quasi A.C. assembly; that is, it includes A.C. and D.C. features. This portion of the panel includes an electrode in the form of a thin metal plate 80 having an array of rows and columns of relatively small apertures 92, each overlying one of the scanning cells. The plate 80 is positioned close to cathodes 60 and may be seated on insulating sheet or layer 74. Layer 74 may alternatively be formed on the lower surface 84 of plate 80, if desired. Electrode plate 80 includes a contact 88 for making electrical connection thereto.

It is noted at this time that, in the operation of the panel 10, the scan anodes 50 and scan cathodes 60 define a primary current flow path, and electrodes 80 and the cathodes 60 define a secondary current flow path.

Figure 3:
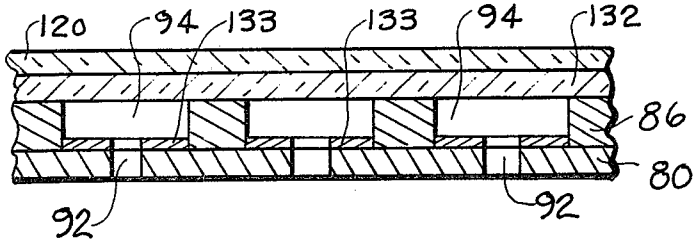
FIG. 3 is an enlarged view of a portion of the panel of FIG. 2, with an added insulating layer 133.

Adjacent to the plate 80, and preferably in contact with the upper surface thereof, is an apertured plate or sheet or layer 86 having rows and columns of apertures 94 which are considerably larger than apertures 92. The apertures 94 comprise the display cells of panel 10. The sheet 86 may be of insulating material, as shown in FIG. 2, or it may be of metal, as shown in FIG. 3, and, if it is of metal, the plates 80 and 86 may be made in one piece, if desired and if feasible.

The quasi A.C. assembly also includes a face plate assembly which includes a single large-area transparent conductive electrode 100 on the inner surface of the plate 30 together with a narrow conductor 110 which outlines and reinforces the electrode layer 100 in conductive contact, to increase its conductivity. If desired, the reinforcement conductor 110 may also include a mesh of fine horizontal and vertical conductor portions on electrode 100, with the openings in the mesh being aligned with the display cells 94. The conductor 110 includes a portion 114, to which external connection can be made. The large-area electrode 100 is of sufficient area to overlie the entire array of display cells 94 in plate 86. An insulating coating 120 of glass or the like covers electrode 100.

If the material of insulating coating 120 provides stable electrical operating characteristics and it does not contain materials which adversely affect panel operation, it need not be coated. However, it may be desirable to coat the glass layer 120 with a dielectric layer 132 of magnesium oxide, thorium oxide, or the like.

In panel 10, the apertures 94 in plate 86 comprise display cells, and, as can be seen in FIG. 2, each display cell has one end wall 134 formed by a portion of insulating layer 132, and an opposite end wall 136 formed by a portion of the top surface of plate 80. To provide cell uniformity and to minimize sputtering, a coating of the material of layer 132 should also be provided on the base or lower wall 136 of each display cell 94, such as the layer 133 shown in FIG. 3.

At the present time, it appears that optimum operation of the panel is achieved if the apertures or cells 94 are unsymmetrical in that insulating layers 120 and 132 together have a thickness greater than layer 133. Indeed, layer 133 may even be thinner than layer 132. Thus, the lower end wall 136 of each cell 94 will have a very high capacitance coupling to the cell, and layer 133 will consequently tend to form only a minimal wall charge in the operation described below. In one mode of construction, both layer 132 and layer 133 may be formed by an evaporation process, and layer 133 may be so thin that it is not completely continuous, which is desirable quality. In any case, however, the character of this wall of the cell is affected by the aperture 92 in the metal plate 80.

The gas filling in panel 10 is preferably a Penning gas mixture of, for example, neon and a small percentage of xenon, at a pressure of about 400 torr. When the panel has been constructed and evacuated, the gas filling is introduced through a tabulation 24 secured to base plate 20 (FIG. 2), or a non-tubulated construction can be employed.

According to the invention, the keep-alive arrangement, in panel 10, includes an A.C. electrode 140 in the form of a linear conductive film or layer of opaque metal, such as silver, provided on the inner surface of the face plate 30 adjacent to one edge of the transparent conductive electrode 100. The A.C. keep-alive electrode 140 is positioned so that, in the completed panel, it lies adjacent to and parallel to the column of reset cells and reset cathode 62, to which it supplies excited particles. The A.C. keep-alive electrode 140 is covered by the insulating layers 120 and 132. In this keep-alive arrangement, the plate 86 is provided with a slot 142, and plate 80 is provided with a column of holes 150. The slot 142 overlies and is aligned with the column of holes 150, and both lie beneath and are aligned with the A.C. electrode 140 so that, in effect, the electrode 140, slot 142 and holes 150 form a sandwich. The slot 142 in the plate 86 is narrower than the opaque A.C. electrode 140 so that a viewer, looking through face plate 30, cannot see any glow which is present in slot 142 and holes 150. Electrode 140 operates with plate 80 to produce glow discharge between them and produce excited particles in slot 142 and holes 150. These excited particles are available to the reset cathode 62 and assist the firing of the column of reset cells.

Figure 4:
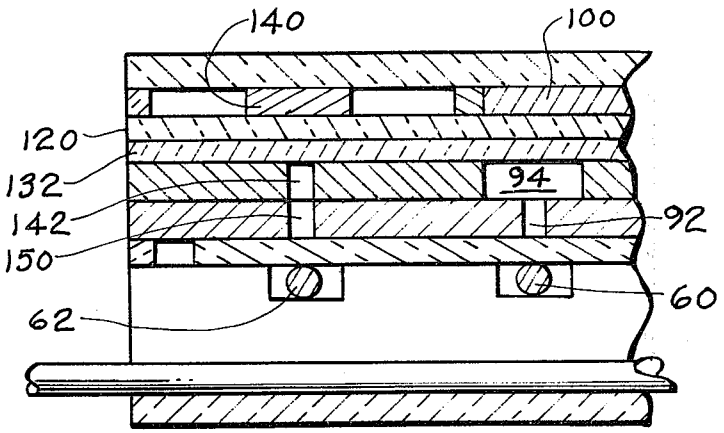
FIG. 4 is a sectional view of a portion of the panel of FIG. 2 showing a modification thereof.

In a modification of the invention illustrated in FIG. 4, the reset cathode 62 is disposed in its slot 64 which is positioned directly beneath the keep-alive electrode 140. With this arrangement, there is closer coupling between the keep-alive structure and its excited particles and the reset cathode so that the reset cells are most readily energized.

Figure 5:
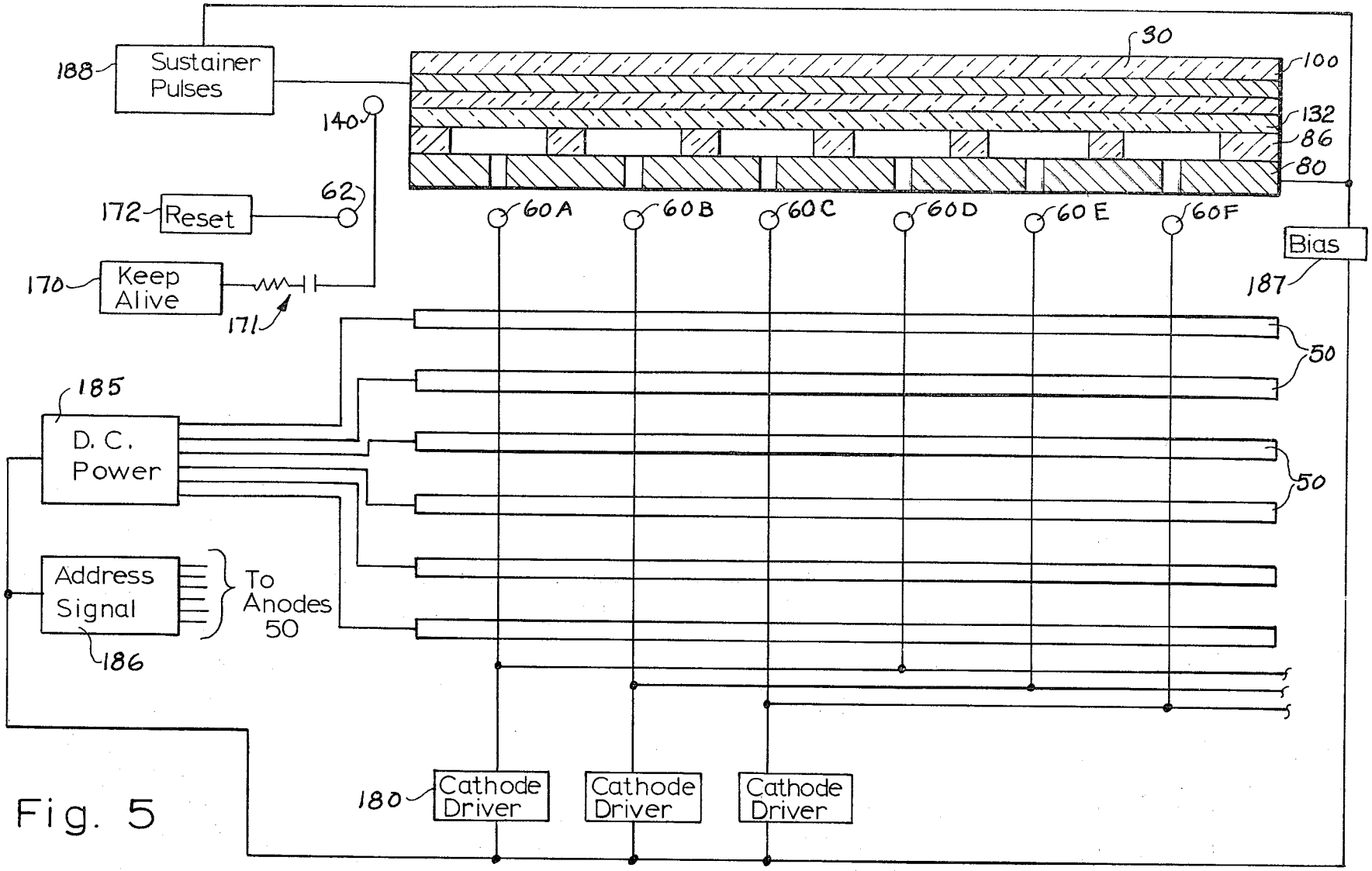
FIG. 5 is a schematic representation of the panel of FIG. 1 and a system in which it may be operated.

A schematic representation of the display panel 10 and a circuit for operating the panel are shown in FIG. 5. The circuit includes a power supply 170, which provides an A.C. signal, coupled through a resistor-capacitor circuit 171, to keep-alive electrode 140. The resistor-capacitor circuit prevents arcing in the keep-alive cells. A source 172 of negative reset pulses is coupled to reset cathode 62. The cathodes 60 are connected in groups or phases with, for example, every third cathode being connected together in the same group, to form three groups or phases, each group being connected to its own cathode driver 180. Other cathode groupings may also be employed, using every fourth or more cathode in each group.

Each of the scan anodes 50 is connected through a suitable resistive path (not shown) to a D.C. power source 185 and to a source 186 of addressing signals to perform write and erase operations. The source of addressing signals 186 may include, or be coupled to, a computer and whatever decoding circuits and the like are required. A source 187 of D.C. bias potential is coupled to plate 80, and a source 188 of alternately positive and negative sustainer pulses is connected to the transparent conductive layer 100.

The detailed operation of the display panel 10 is described in the above-identified copending application and will not be repeated in as much detail as therein. A brief description of the operation of the invention and the panel is as follows. Concerning the keep-alive structure, the purpose of this portion of the panel is to provide a source of excited particles for the reset cathode at the beginning of a scanning cycle. Thus, it is desirable to maintain the keep-alive structure constantly energized and generating such excited particles, and, in one suitable arrangement, this is achieved by applying, between the electrode 140 and the plate 80, pulses having a frequency in the range of about 3 to 300 KHz and an amplitude about equal to or somewhat greater than the scan anode supply voltage of about 275 volts. Other circuit parameters might also be used to achieve the desired keep-alive functions.

With the keep-alive electrode thus generating excited particles, and with operating potential applied to the scan anodes, the reset cathode is energized to fire the column of reset cells, and then the scan cathodes are energized sequentially to carry out a scanning operation in the lower portion of the panel. At the same time, with sustaining pulses applied to the electrode, as each column of scan cells is energized, information or display signals are applied to the proper scan anodes to cause glow to develop in the associated display cells where it is sustained by the sustaining pulses. When all of the columns of scan cells have been energized and the appropriate associated display cells have been energized, a sustained message is present in the upper portion of the panel.

The mechanical and electrical operating parameters of one panel which has been built and operated satisfactorily are set forth in the above-identified application. For convenience, they are also set forth below with the parameters of the keep-alive mechanism added thereto.

In that panel, the cathode wires 60 had a diameter of about 3 mils; the apertures 90 in plate 80 had a diameter of about 3 mils and a depth of about 3 mils; and the keep-alive apertures 150 had a diameter in the range of about 6 mils to about 8 mils; the spacing between the cathodes 60 and plate 80 was about 3 mils; the spacing between the cathodes 60 and anodes 50 was about 30 mils; the display cells 94 had a diameter (or width) of about 15 mils and a depth of about 4 mils; and the cells had a spacing of about 20 mils, center to center. The gas filling was 99.8% neon and 0.2% xenon at a pressure of about 400 torr. Layers 120 and 132 together had a thickness in the range of 2 microns to 40 microns (preferably about 20 microns), and layer 133 had a thickness from about 300 angstroms to 30,000 angstroms (preferably 5000 to 6000 angstroms).

For a panel having these mechanical parameters, one set of operable electrical parameters (with all voltages referenced to an "on" scan cathode 60) is as follows:

1. The scan/address anodes 50 are connected through a resistive path to a D.C. power source 185 of about 275 volts, and the anodes are at a sustaining potential of about 175 volts when scanning cells are "on".

2. The scan cathodes carry an off-bias voltage of about 75 to 120 volts and a turn-on voltage of about 0 volts. The turn-on pulses have a duration in the range of 50 μs to 100 μs.

3. The bias voltage on plate 80 is in the range of 75 to 120 volts, but preferably 100 volts.

4. The sustainer pulses have positive and negative symmetrical excursions above and below the bias potential on plate 80 in the range of 70 to 100 volts, with 90 volts being a favorable voltage, and a frequency in the range of 5–30 KHz. Each pulse has a duration of 5 μs and the spacing between pulses is 10 μs.

5. The information or display signals are applied during a positive sustainer pulse and have a negative voltage excursion to about 100 volts with respect to an "on" cathode, and they have a duration of a few μs.

6. The keep-alive pulses have a negative excursion from a maximum about 50 volts greater than the supply voltage of the scan anodes to about zero volts. A sufficient number of keep-alive pulses are applied during and prior to the time when the reset cathode is energized to insure that the keep-alive cells are on and provide sufficient excited particles for all of the reset cells to fire.

What is claimed is:

1. A display panel comprising an array of D.C. gas discharge cells disposed in a first layer and an adjacent array of A.C. gas discharge cells disposed in a second layer, the D.C. cells being in gas communication with the A.C. cells, the D.C. gas discharge cells including a column of reset cells and succeeding columns of scanning or priming cells, the A.C. cells including an electrode insulated from the gas therein and an apertured D.C. electrode, a keep-alive arrangement including a keep-alive A.C. electrode and a portion of said D.C. electrode, and means for applying A.C. signals between said keep-alive A.C. electrode and said D.C. electrode to cause a glow discharge and the generation of excited particles, the excited particles being generated adjacent to said reset cells to facilitate the firing thereof, there being one aperture in said D.C. apertured electrode for each A.C. cell and auxiliary aperture means in said D.C. apertured electrode for said keep-alive arrangement to permit excited particles generated whereby to reach said column of reset cells.

2. A display panel comprising an array of D.C. gas discharge cells disposed in a first layer and an adjacent array of A.C. gas discharge cells disposed in a second layer, the D.C. cells being in gas communication with the A.C. cells, the D.C. gas discharge cells including a column of reset cells and succeeding columns of scanning or priming cells, the A.C. cells including an electrode insulated from the gas therein and an apertured D.C. electrode, a keep-alive arrangement including a keep-alive A.C. electrode and a portion of said D.C. electrode, said keep-alive arrangement being positioned closer to said reset cells than said priming cells, and means for applying A.C. signals between said keep-alive A.C. electrode and said D.C. electrode to cause a glow discharge and the generation of excited particles, the excited particles being generated adjacent to said reset cells to facilitate the firing thereof, there being one aperture in said D.C. apertured electrode for each A.C. cell and auxiliary aperture means in said D.C. apertured electrode for said keep-alive arrangement to permit excited particles generated thereby to reach said column of reset cells.

3. A display panel comprising an array of D.C. gas discharge cells disposed in a first layer and an adjacent array of A.C. gas discharge cells disposed in a second layer, the D.C. cells being in gas communication with the A.C. cells, the D.C. gas discharge cells including a column of reset cells and succeeding columns of scanning or priming cells, the A.C. cells including an electrode insulated from the gas therein and an apertured D.C. electrode, a keep-alive arrangement including a keep-alive A.C. electrode and a portion of said D.C. electrode, said keep-alive arrangement being positioned in vertical alignment with said column of reset cells, and means for applying A.C. signals between said keep-alive A.C. electrode and said D.C. electrode to cause a glow discharge and the generation of excited particles, the excited particles being generated adjacent to said reset cells to facilitate the firing thereof.

4. A display panel comprising an array of D.C. gas discharge cells disposed in a first layer and including a first array of rows of parallel anode wires and a second array of columns of parallel cathode wires, said anode wires being spaced from said cathode wires, the crossings of said wires defining a column of reset cells and succeeding columns of scanning or priming cells, an adjacent array of A.C. gas discharge cells disposed in a second layer, the D.C. scanning cells being in gas communication with the A.C. cells, the A.C. cells including an electrode insulated from the gas therein and an apertured D.C. electrode, said apertured D.C. electrode being disposed between said A.C. cells and said D.C. cells, a keep-alive arrangement including a keep-alive A.C. electrode and a portion of said D.C. electrode, and means for applying A.C. signals between said keep-alive A.C. electrode and said D.C. electrode to cause a glow discharge and the generation of excited particles, the excited particles being generated adjacent to said reset cells to facilitate the firing thereof, there being one aperture in said D.C. apertured electrode for each A.C. cell and auxiliary aperture means in said D.C. apertured electrode for said keep-alive arrangement to permit excited particles generated thereby to reach said column of reset cells.

5. A display panel comprising a gas-filled envelope made up of a base plate and a face plate viewing window hermetically sealed together and containing, an array of D.C. gas discharge cells disposed in a first layer adjacent to said base plate and including a first array of rows of parallel anode wires and a second array of columns of parallel cathode wires, said anode wires being spaced from said cathode wires, the crossings of said wires defining a column of reset cells and succeeding columns of scanning or priming cells, an adjacent array of A.C. gas discharge cells disposed in a second layer, the D.C. scanning cells being in gas communication with the A.C. cells, the A.C. cells including a transparent electrode insulated from the gas therein and an apertured D.C. electrode, said transparent electrode being supported on said face plate and covered with a layer of glass, said apertured D.C. electrode being disposed between said A.C. cells and said D.C. cells, a keep-alive arrangement including a keep-alive A.C. electrode and a portion of said D.C. electrode, said keep-alive A.C. electrode being supported on said face plate and covered with a layer of glass, and means for applying A.C. signals between said keep-alive A.C. electrode and said D.C. electrode to cause a glow discharge and the generation of excited particles, the excited particles being generated adjacent to said reset cells to facilitate the firing thereof.

6. The panel defined in claim 5 wherein said keep-alive arrangement is positioned close to said column of reset cells.

7. The panel defined in claim 5 wherein said A.C. electrode of said keep-alive arrangement is positioned over and in alignment with the cathode wire associated with said column of reset cells.

8. A display panel comprising a gas-filled envelope made up of a glass face plate and an insulating base plate hermetically sealed together but spaced therefrom, an array of D.C. gas discharge cells disposed in a first layer adjacent to said base plate and including a first array of rows of parallel elongated anode row electrodes and a second array of columns of parallel elongated cathode column electrodes, said anode electrodes being spaced from said cathode electrodes, the crossings of said anode and cathode electrodes defining a first column of reset cells and succeeding columns of scanning or priming cells, an adjacent array of A.C. gas discharge display cells disposed in a second layer, each D.C. scanning cell being in gas communication with at least one A.C. cell, the A.C. cells including a large-area electrode formed on the inner surface of said face plate and insulated from the gas therein by an insulating coating, and an apertured plate electrode, said apertured plate electrode being disposed adjacent to said insulating layer covering said large-area electrode and between said A.C. cells and said D.C. cells, there being one aperture in said plate associated with each A.C. cell, and a keep-alive arrangement which is not to be viewed but serves to provide excited particles for said D.C. cells, especially said column of reset cells, said keep-alive arrangement including a keep-alive A.C. electrode on the inner surface of said face plate and a portion of said apertured plate, said apertured plate having auxiliary aperture means aligned with said keep-alive A.C. electrode and providing gas communication therethrough with said column of reset cells, said keep-alive arrangement being adapted to receive A.C. signals between said keep-alive A.C. electrode and said apertured plate electrode to cause a glow discharge and the generation of excited particles, the excited particles being generated adjacent to said reset cells to facilitate the firing thereof.

9. The panel defined in claim 8 wherein said keep-alive A.C. electrode is a linear electrode and said auxiliary aperture means in said apertured plate comprises a column of small holes generally aligned with said keep-alive A.C. electrode.

10. The panel defined in claim 8 wherein the apertures in said apertured plate include a large-area display portion disposed adjacent to said face plate and a small-diameter hole adjacent to a cathode electrode, and said auxiliary aperture means includes an elongated slot which communicates with a column of small holes, said slot and said holes being aligned with said keep-alive A.C. electrode.

11. The panel defined in claim 8 wherein said keep-alive arrangement is positioned close to said column of reset cells.

12. The panel defined in claim 8 wherein said A.C. electrode of said keep-alive arrangement is positioned over and in alignment with the cathode electrode which is associated with said column of reset cells.

13. A display panel comprising a gas-filled envelope made up of a glass face plate and an insulating base plate hermetically sealed together and containing an array of D.C. gas discharge cells disposed in a first layer and an adjacent array of A.C. gas discharge display cells disposed in a second layer, the D.C. cells being in gas communication with the A.C. cells, said D.C. cells being characterized by having their electrodes in contact with the gas in said envelope and operable with D.C. voltages and said A.C. cells being characterized by having at least one electrode insulated from the gas in said envelope and operable with A.C. or pulse signals, the D.C. gas discharge cells including a column of reset cells and succeeding columns of scanning or priming cells which are operable to address said display cells, the A.C. cells including an electrode insulated from the gas therein and an apertured plate electrode positioned adjacent to said D.C. cells and having an aperture disposed between an A.C. cell and a D.C. cell, a keep-alive electrode arrangement including a keep-alive A.C. electrode and a portion of said plate electrode, said plate electrode having auxiliary aperture means for said keep-alive electrode arrangement, and means for applying A.C. signals between said keep-alive A.C. electrode and said plate electrode to cause a glow discharge and the generation of excited particles, the excited particles being generated adjacent to said reset cells to facilitate the firing thereof.

* * * * *